US006390055B1

(12) United States Patent
Sivashankar et al.

(10) Patent No.: US 6,390,055 B1
(45) Date of Patent: May 21, 2002

(54) ENGINE MODE CONTROL

(75) Inventors: Narayanan Sivashankar, Canton; Jing Sun, Bloomfield Township, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 37 days.

(21) Appl. No.: 09/649,779

(22) Filed: Aug. 29, 2000

(51) Int. Cl.[7] ..... F02B 17/00
(52) U.S. Cl. ..... 123/295; 123/430; 123/436
(58) Field of Search ..... 123/295, 299, 123/300, 305, 430, 435, 436

(56) References Cited

U.S. PATENT DOCUMENTS 4,926,335 A 5/1990 Flowers et al.
5,020,363 A 6/1991 Schnaibel et al.
5,136,517 A 8/1992 Cullen et al.
5,755,198 A * 5/1998 Grob et al. ..... 123/295
5,947,079 A * 9/1999 Sivashankar et al. ..... 123/295
5,975,044 A * 11/1999 Kamura et al. ..... 123/295
6,016,460 A 1/2000 Olin et al.
6,079,387 A * 6/2000 Mamiya et al. ..... 123/295
6,116,210 A * 9/2000 Oder et al. ..... 123/295
6,244,243 B1 * 6/2001 Mamiya et al. ..... 123/295

* cited by examiner

*Primary Examiner*—John Kwon
*Assistant Examiner*—Hieu T. Vo
(74) *Attorney, Agent, or Firm*—John D. Russell; Allan J. Lippa

(57) ABSTRACT

A method of controlling an internal combustion engine is described. The engine is capable of operating in at least two engine operating modes. As an example, the engine can operate in a stratified or a homogeneous combustion mode. The engine operating mode is selected based on a determined atmospheric pressure.

14 Claims, 5 Drawing Sheets

ENGINE MODE CONTROL

FIELD OF THE INVENTION

The present invention relates to an engine control system and method and more particularly to a method for adjusting when an engine mode transition in a direct injection stratified charge (DISC) engine control scheme is executed.

BACKGROUND OF THE INVENTION

In direct injection spark ignition engines, the engine operates with stratified air/fuel operation in which the combustion chamber contains stratified layers of different air/fuel mixtures. The strata closest to the spark plug contain a stoichiometric mixture or a mixture slightly rich of stoichiometry, and subsequent strata contain progressively leaner mixtures.

The engine may also operate in a homogeneous mode of operation with a homogeneous mixture of air and fuel generated in the combustion chamber by early injection of fuel into the combustion chamber during the intake stroke. Homogeneous operation may be either lean of stoichiometry, at stoichiometry, or rich of stoichiometry.

Direct injection engines are also coupled to three-way catalytic converters to reduce CO, HC, and NOx. If desired, a second three-way catalyst, known as a NOx trap, is typically coupled downstream of the first three-way catalytic converter to further reduce NOx.

The stratified mode of operation is typically utilized when the engine is operating in light to medium loads. The homogeneous mode of operation is typically used from medium to heavy load operating conditions. In certain conditions, it is necessary to transition from one engine mode of operation to the other. During these mode transitions, it is desired to deliver the requested engine output torque to provide good drive feel. Typically, the determination of when to transition is based on a fuel injection amount, or a desired engine, or powertrain, torque. One such a method, which uses fuel injection amount, is described in U.S. Pat. No. 4,955,339.

The inventors herein have recognized a disadvantage with the above approach. In particular, at higher altitudes, a given engine torque value can be achieved in the stratified mode only by supplying excess fuel with insufficient air. Insufficient air is caused by barometric pressure changes, which provide a lower ambient pressure driving force to fill the engine cylinders with air, i.e., the maximum amount of air that can fill the engine cylinders is reduced as barometric pressure falls, Supplying excess fuel with insufficient air may lead to unacceptable combustion quality with excessive smoke and soot, or may result in emission and driveability degradation. For the transient response during a mode switch, insufficient air may also lead to a torque disturbance since the switch point may not provide equivalent engine output.

SUMMARY OF THE INVENTION

The above disadvantages are overcome by a method for controlling an internal combustion engine of a vehicle, the engine operating in at least a first and second operating mode. The method comprises determining a parameter indicative of atmospheric pressure, and selecting one of the first and second operating modes based in part on said parameter.

By adjusting the boundary of the stratified operation when there is less air available at higher altitude and lower barometric pressure, it is possible to obtain improved engine operation. For example, it is possible to obtain improved combustion or smooth transitions between operating modes.

An advantage of the invention is that by having a mode selection that takes into account atmospheric pressure changes, it is possible to obtain improved vehicle performance, since the lower level of engine airflow is considered.

Another advantage of the present invention is that a mode selection that takes into account atmospheric pressure changes, it is possible to operate the engine in acceptable air/fuel ratio ranges and thereby prevent smoke or soot due to degraded combustion.

Other advantages of the invention will become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention. In the drawings.

DETAILED DESCRIPTION OF PREFERRED EMBODIMENTS

Figure 1:
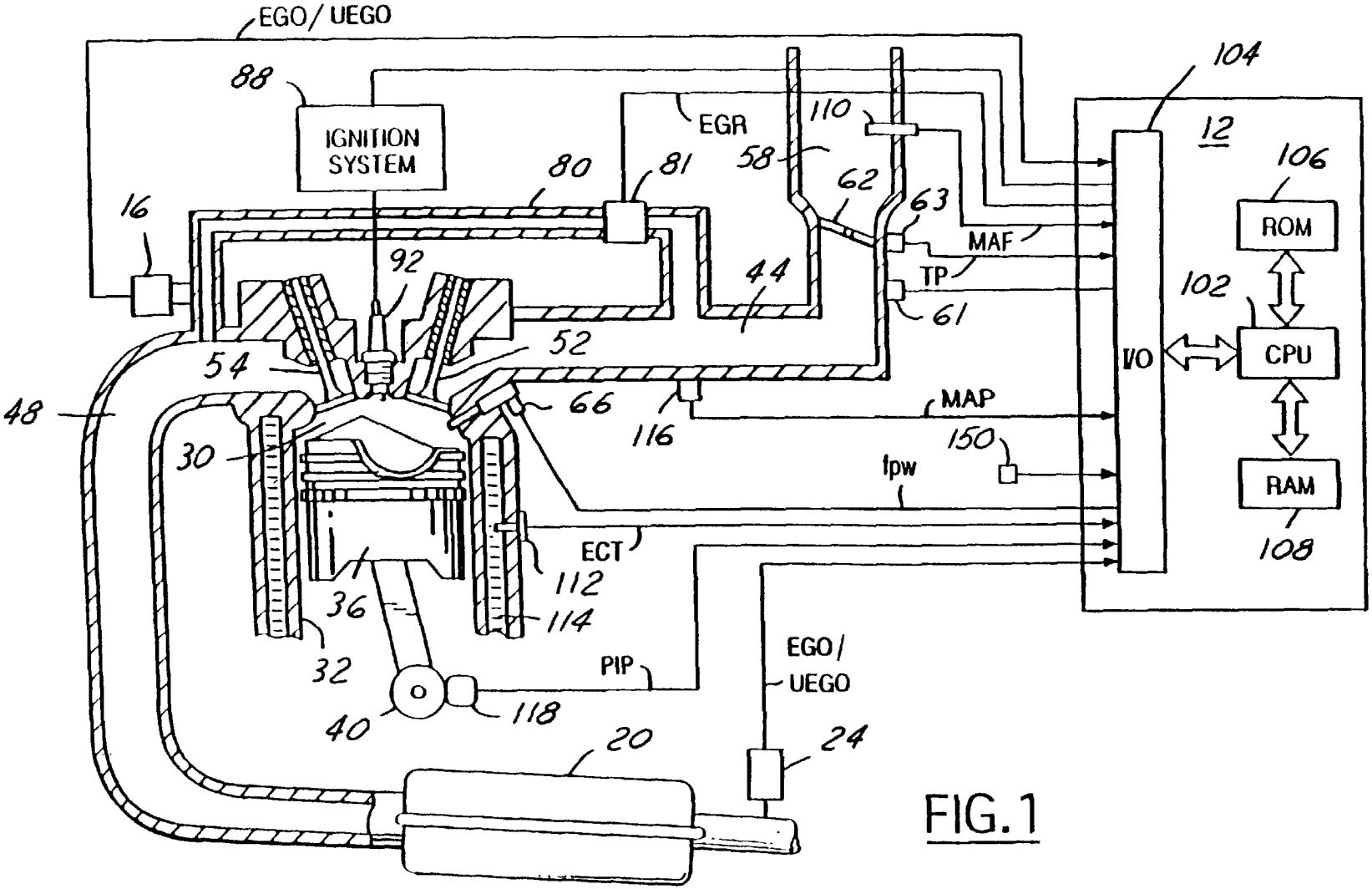
FIG. 1 is a block diagram of a DISC engine system where the present invention may be used to advantage.

Although the present method may be utilized in a PFI engine environment, it will be discussed in the context of a DISC engine with the understanding that it is not intended to be limited thereto. Referring now to FIG. 1, there is shown a block diagram of a DISC engine system. The DISC engine system includes the engine 10 comprising a plurality of cylinders, one cylinder of which shown in FIG. 1, is controlled by an electronic engine controller 12. In general, controller 12 controls the engine air, fuel (timing and quality), spark, EGR, etc., as a function of the output of sensors such as exhaust gas oxygen sensor and/or proportional exhaust gas oxygen sensor (16 and 24 in FIG. 1). Continuing with FIG. 1, engine 10 includes a combustion chamber 30 and cylinder walls 32 with piston 36 positioned therein and connected to a crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Preferably, throttle plate 62 is electronically controlled via drive motor 61. The combustion chamber 30 is also shown communicating with a high pressure fuel injector 66 for delivering fuel in proportion to the pulse width of signal FPW from controller 12. Fuel is delivered to the fuel injector 66 by a fuel system (not shown) which includes a fuel tank, fuel pump, and high pressure fuel rail.

The ignition system 88 provides ignition spark to the combustion chamber 30 via the spark plug 92 in response to the controller 12.

Controller 12 as shown in FIG. 1 is a conventional microcomputer including a microprocessor unit 102, input/output ports 104, read-only memory 106, random access memory 108, and a conventional data bus. Controller 12 is shown receiving various signals from sensors coupled to the engine 10, in addition to those signals previously discussed, including: measurements of inducted mass airflow (MAF) from mass airflow sensor 110, coupled to the throttle body 58; engine coolant temperature (ECT) from temperature sensor 112 coupled to the cooling sleeve 114; a measurement of manifold pressure (MAP) from manifold sensor 116 coupled to intake manifold 44; throttle position (TP) from throttle position sensor 63; ambient air temperature from temperature sensor 150; and a profile ignition pickup signal (PIP) from Hall effect sensor 118 coupled to crankshaft 40.

The DISC engine system of FIG. 1 also includes a conduit 80 connecting the exhaust manifold 48 to the intake manifold 44 for exhaust gas recirculation (EGR). Exhaust gas recirculation is controlled by EGR valve 81 in response to signal EGR from controller 12.

The DISC engine system of FIG. 1 further includes an exhaust gas after-treatment system 20 which includes a first three-way catalyst (TWC) and a second three way catalyst known as an $NO_x$, trap (LNT).

Figure 2:
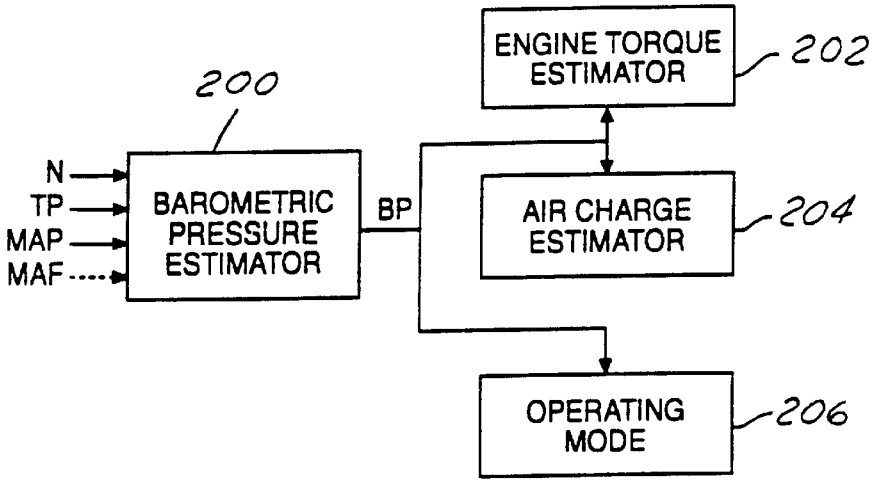
FIG. 2 is a block diagram of a control system where the present invention may be used to advantage.
Figure 3:
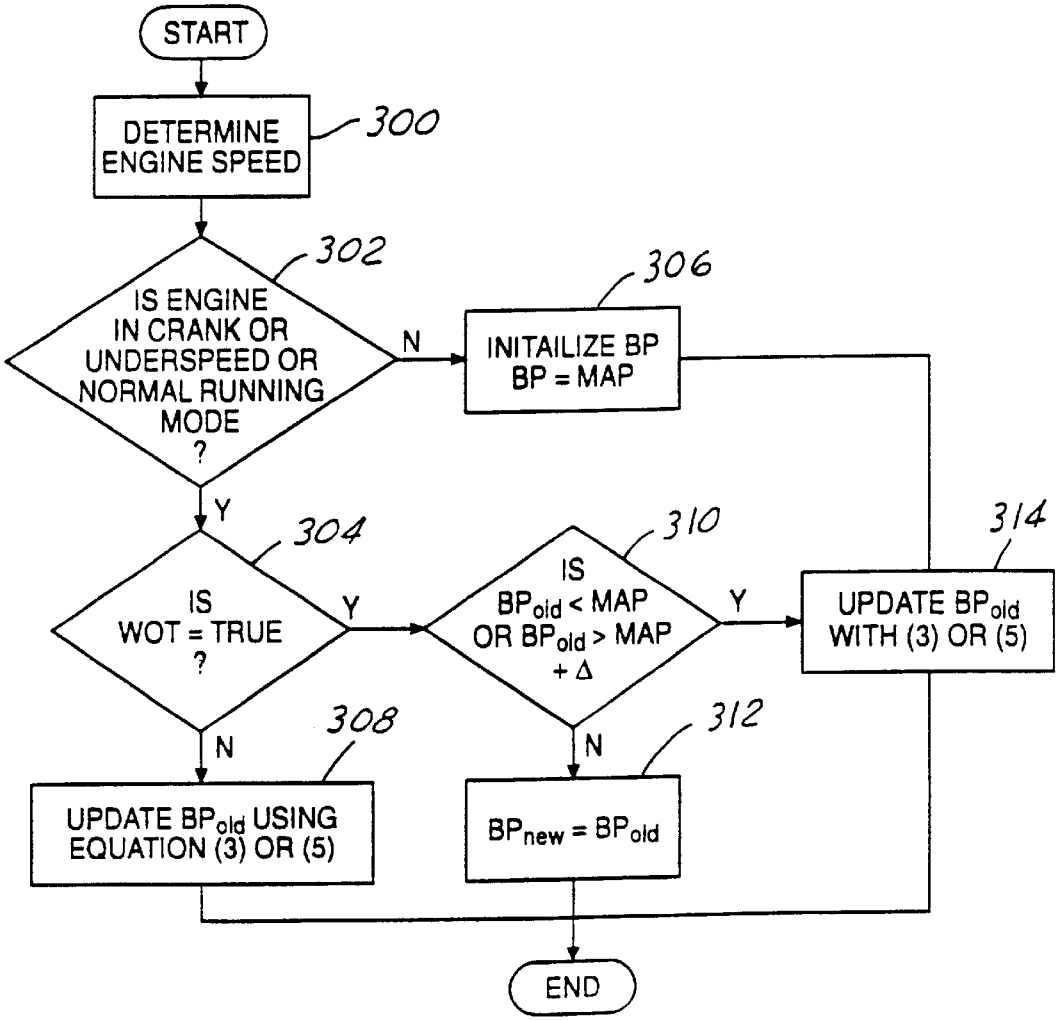
FIGS. 3–6 is a logic flow diagram of the present method of estimating barometric pressure in an engine control scheme.

Referring now to FIG. 2, there is shown a block diagram of a control scheme where the present method may be used to advantage. The barometric pressure estimator which is described in detail below with reference to FIG. 3, is shown in block 200. The estimator 200 receives as inputs the engine speed signal (N) from the PIP signal, throttle position (TP) from the throttle position sensor 63, MAP and, optionally, MAF. The estimator then generates a value representing the present barometric pressure (BP) for use by the engine torque estimator 202 and/or air charge estimator 204. The BP signal can also be used to dictate the operating mode 206 of the engine-stratified or homogeneous. Preferably, these functional blocks 200, 202, 204, 206 are contained within the controller 12, although one or more of them could be stand-alone sub-controllers with an associated CPU, memory, I/O ports and databus. Of course, the actual engine control scheme can be any engine control method that uses BP as an input to generate desired engine operating values such as fueling rate, spark timing and airflow.

In a first embodiment of the present method, measurements of intake manifold absolute pressure (MAP) and mass airflow (MAF) are both available to the controller. In this case, the inventive method starts from the standard orifice equation for the engine throttle body:

$$\dot{m}_{th} = f(\theta)\frac{P_a}{\sqrt{T_a}}\,g\left(\frac{P}{P_a}\right) \tag{1}$$

where P, $P_a$ and $T_a$ is the intake manifold pressure(kPa), ambient pressure (kPa) and ambient temperature (K) respectively, $\dot{m}_{th}$ is the air mass flow rate through the throttle, θ is the throttle valve position and f (θ) represents the effective flow area which depends on the geometry of the throttle body. The function g depends on the pressure ratio across the throttle body which can be approximated by:

$$g\left(\frac{P}{P_a}\right) = 1 \qquad \text{for } P/P_a \le 0.5 \tag{2}$$

-continued $$g\left(\frac{P}{P_a}\right) = \frac{2P}{P_a}\sqrt{\frac{P_a}{P} - 1} \quad \text{for } P/P_a > 0.5$$

Since all of the variables in equation (1) are either measured or known, except barometric pressure $P_a$, equation (1) could be used to solve for $P_a$. It has been found, however, that this solution leads to an estimate of $P_a$, which is very susceptible to measurement noises, especially during high intake manifold pressure conditions (such as in the stratified operation and lean homogeneous operation). Thus, the present method uses the following estimation equation which overcomes this deficiency and provides a robust estimation for the barometric pressure for WOT operation and all other engine operating states:

$$\hat{P}_a^{new} = \hat{P}_a^{old} + \gamma_2\frac{\dot{m}_{th}}{1+\dot{m}_{th}^2}\left(\dot{m}_{th} - \hat{\dot{m}}_{th}\right)$$

where $\dot{m}_{th}$, P are measured flow and intake manifold pressure, $\hat{\dot{m}}th$ is calculated as:

$$\hat{\dot{m}}_{th} = f(\theta)\frac{\hat{P}_a^{old}}{\sqrt{T_a}}\,g\left(\frac{P}{\hat{P}_a^{old}}\right) \tag{4}$$

and $\gamma_1$, $\gamma_2$ are adaptation gains which can be calibrated to achieve desired performance. The method is employed in real-time and thus the representations "old" and "new" represent the previously determined values and presently determined values, respectively. In equation (3), the barometric pressure estimation is adjusted incrementally according to the prediction error $\dot{m}_{th}-\hat{\dot{m}}_{th}$, to desensitize it to the measurement noises.

In a second embodiment of the present method, only a manifold absolute pressure (MAP) sensor is included in the engine sensor set. In this case where MAF measurement is not available, the following equation is used to update the barometric pressure for WOT and all other engine operating states:

for WOT, $$\dot{P}th_a^{new} = \hat{P}th_a^{old} + \gamma_1(Pth_a^{old}) \tag{5}$$

else $$\hat{P}_a^{new} = \hat{P}_a^{old} + \gamma_2\frac{P}{1+P^2}\left(P - \hat{P}\right)$$

where P and $\hat{\dot{m}}_{th}$ are the estimated intake manifold pressure and air flow calculated from:

$$\hat{\dot{m}}_{th} = f(\theta)\frac{\hat{P}_a^{old}}{\sqrt{T_a}}\,g\left(\frac{P}{\hat{P}_a^{old}}\right),\ \dot{\hat{P}} = K\left(\hat{\dot{m}}_{th} - h(N, P)\right) \tag{6}$$

The function h is the engine pumping term which is obtained from engine mapping data and the constant K is calibrated using dynamometer data. In equation (5), the barometric pressure is updated according to the prediction error in the intake manifold pressure.

In another embodiment of the present invention, a barometric pressure sensor is used to measure atmospheric pressure. The sensor could be a differential pressure sensor references to a known pressure, an absolute pressure sensor, or any other sensor that provides a measurement of atmospheric pressure. For example, atmospheric pressure could be determined from information provided by a global positioning system which indicates altitude. In such a case, a map could be used which provides approximate altitude values (and corresponding atmospheric pressure values) based on latitude and longitude values of the vehicle. The map coverage could be for a specific city, for a region, or for a country, or for an entire continent. Alternatively, controller 12 could utilize global position data and a map to determine, on board, the approximate altitude and corresponding atmospheric pressure.

In all embodiments, the engine torque, the cylinder air charge, and stratified lean rich limit are scaled based on the barometric pressure estimation as shown, for example, in FIG. 2.

Referring now to FIG. 3, there is shown a logic flow diagram of a barometric pressure estimator according to the present invention. Two estimator schemes are presented in FIG. 3 depending upon the vehicle sensor set.

In step 300, the engine speed (N) is determined. In step 302, the system determines the operating mode of the engine. If the engine is in normal running (running, crank or under-speed) mode, the logic continues to step 304. Otherwise, the engine would be in the "key-on" state. The barometric pressure value is initialized to be approximately equal to MAP in step 306. In step 304, it is determined whether the engine is operating at wide-open throttle (WOT). If not, the value for $P_{old}$ is updated according to equation (3) or equation (5) in step 308 depending upon the sensor set available, i.e., MAP only or MAP and MAF. If, however, the engine is operating at WOT, the logic branches to step 310. If a WOT condition exists, a dead-band is applied in step 310 to prevent BP adaptation when the estimated BP is slightly higher (Δ) than the intake pressure. In such cases, the new value for BP is set equal to the previous in step 312. Otherwise, the BP value is updated according to equation (3) or (5) for the WOT condition, depending upon the available sensor set.

In the case of PFI engines, the function $f(\theta)$ represents an effective area term that takes into account both the throttle and air bypass valve openings.

The present method can also be modified to account for pulsations in the measurement of P and $\dot{m}_{th}$ which are caused by engine intake events. The effects of pulsations on the integrity of the BP estimation scheme can be improved by averaging the measurement over each engine event, or by using other known filtering techniques. The present method can also be integrated with other throttle body adaptive algorithms designed to compensate for throttle body leakage or other variations. Furthermore, rather than updating barometric pressure at every sample time, the value could be periodically determined at predefined intervals.

Figure 4:
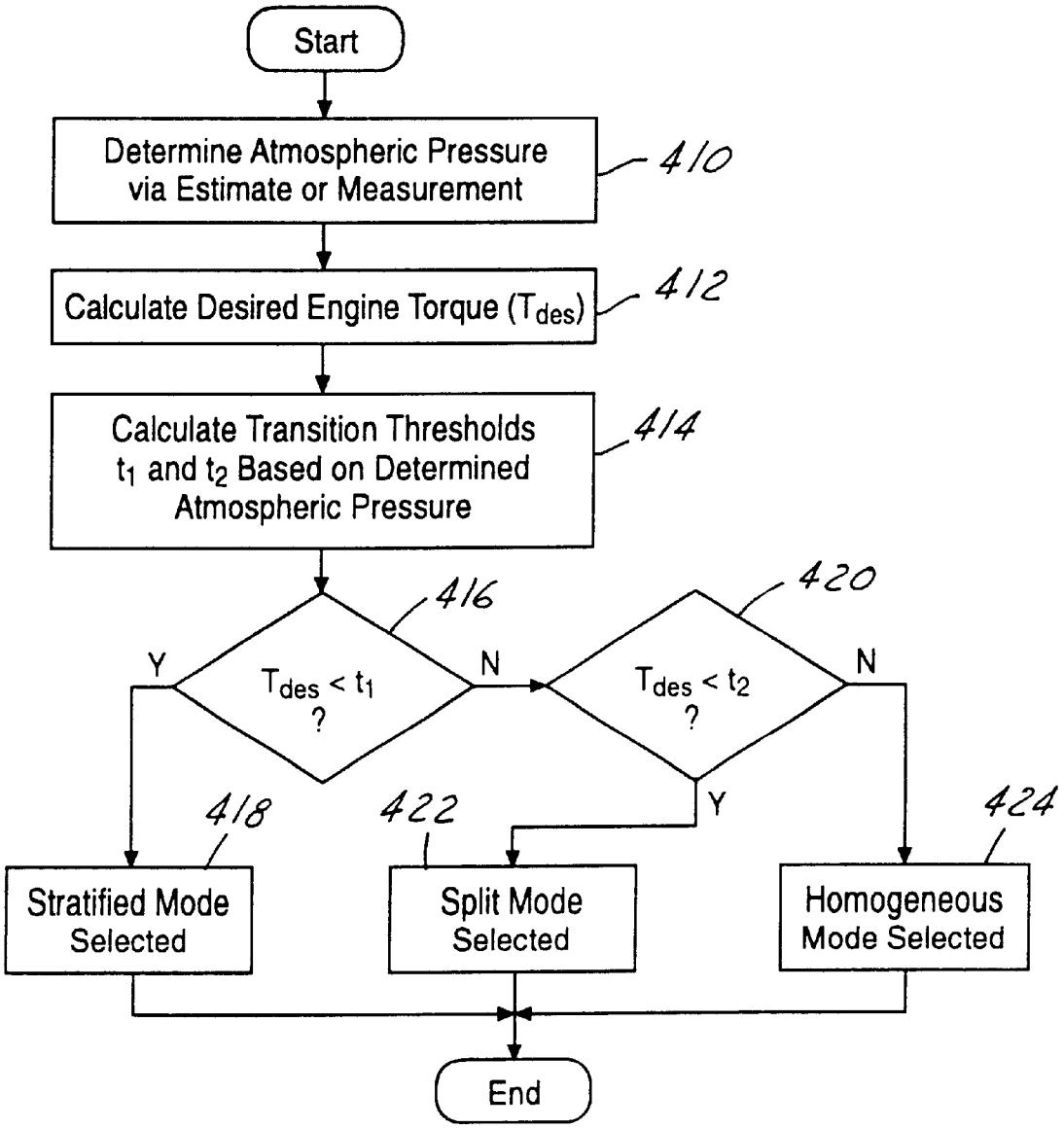

Referring now to FIG. 4, a routine is described for selecting an engine operating mode. First, in step 410, atmospheric pressure is determined. Atmospheric pressure can be determined via any of the estimates or measurements described herein above. Then, in step 412, desired engine torque is calculated. For example, it can be calculated based on a driver actuated element (foot pedal), from a vehicle cruise control system, from a traction control system, or from any other engine control system. Then, in step 414, transition thresholds t1 and t2 are determined based on the determined atmospheric pressure. Typically, the thresholds are decreased at atmospheric pressure is decreased.

In this example, two thresholds are determined for three operating modes: stratified, split, and homogeneous. Typically, the stratified mode is provided by injecting fuel during the engines compression stroke, the homogeneous mode is provided by injecting fuel during the engines intake stroke, and the split mode is provided by injecting fuel during both the engines compression stroke and intake stroke. If, for example, only the stratified and homogeneous modes were utilized, a single transition threshold could be sufficient.

Continuing with FIG. 4, in step 416, a determination is made as to whether the desired engine torque is less than threshold t1. When the answer to step 416 is YES, the stratified mode is selected in step 418. Otherwise, a determination is made as to whether the desired engine torque is less than threshold t2 in step 420. When the answer to step 420 is YES, the split mode is selected in step 422. Otherwise, in step 424, the homogeneous mode is selected.

In this way, it is possible to select the engine operating mode based on a parameter indicative of atmospheric pressure and obtain an advantage of improved engine operation at varying altitudes.

Figure 5:
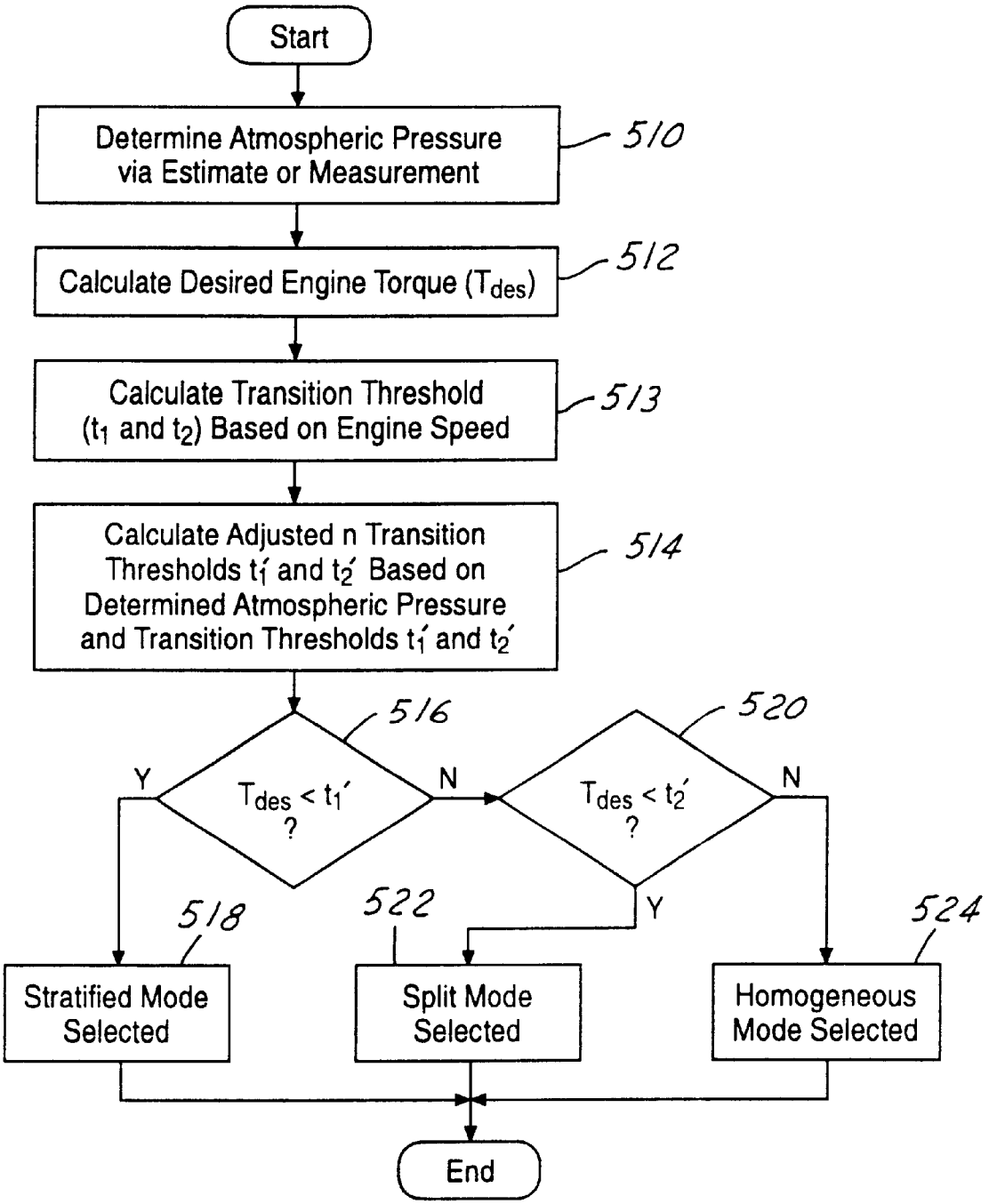

Referring now to FIG. 5, an alternate routine is described for selecting an engine operating mode. First, in step 510, atmospheric pressure is determined. Atmospheric pressure can be determined via any of the estimates or measurements described herein above. Then, in step 512, desired engine torque is calculated. For example, it can be calculated based on a driver actuated element (foot pedal), from a vehicle cruise control system, from a traction control system, or from any other engine control system. In step 513, transition thresholds t1 and t2 are determined based on the operating conditions including engine speed. Then, in step 514, adjusted transition thresholds t'1 and t'2 are determined based on the determined atmospheric pressure. Typically, the thresholds are decreased at atmospheric pressure is decreased.

Again, in this example, two thresholds are determined. However, as described above, different numbers of thresholds can be used depending on the number of different operating modes.

Continuing with FIG. 5, in step 516, a determination is made as to whether the desired engine torque is less than threshold t'1. When the answer to step 516 is YES, the stratified mode is selected in step 518. Otherwise, a determination is made as to whether the desired engine torque is less than threshold t'2 in step 520. When the answer to step 520 is YES, the split mode is selected in step 522. Otherwise, in step 524, the homogeneous mode is selected.

In this way, it is possible to select the engine operating mode based on a parameter indicative of atmospheric pressure and obtain an advantage of improved engine operation at varying altitudes.

Figure 6:
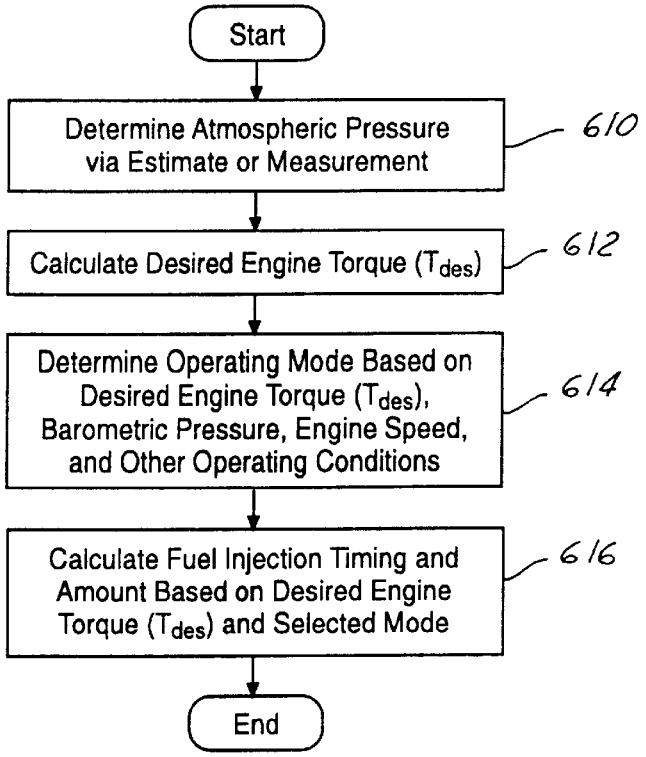

Referring now to FIG. 6, a routine is described for selecting an engine operating mode of the engine and for controlling the engine actuators. In step 610, atmospheric pressure is determined. Atmospheric pressure can be determined via any of the estimates or measurements described herein above. Then, in step 612, desired engine torque is calculated. For example, it can be calculated based on a driver actuated element (foot pedal), from a vehicle cruise control system, from a traction control system, or from any other engine control system. In step 614, an engine operating mode is selected based on the desired engine torque, engine speed, determined atmospheric pressure, and other operating parameters which could include temperature, for example. As an example, the FIG. 7A or 7B, described later herein, could be programmed into controller 12 and used in selected the engine operating mode based on engine speed and engine torque. Then, in step 616, a fuel injection amount is calculated based on the desired engine torque, the selected engine operation mode, engine speed, and other parameters, which may include ignition timing or air/fuel ratio.

Figure 7A:
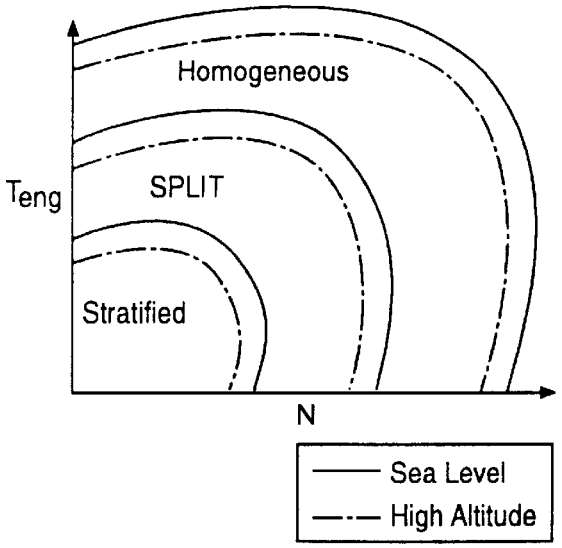
FIGS. 7A and 7B are graphs illustrating operation according to the present invention.
Figure 7B:
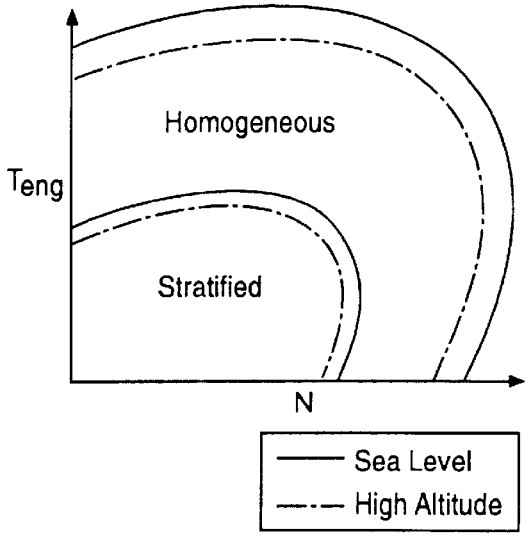

Referring now to FIGS. 7A and 7B, the present invention is illustrated graphically. Here, the engine operating modes are illustrated versus engine speed and engine torque. The solid lines represent the transition points at sea level, while the dash-dot lines represent the transition points at higher altitudes. Those skilled in the art will recognize, in view of this disclosure, that that the dash-dot line could vary depending on the altitude, or atmospheric pressure, in which the vehicle was operating. FIG. 7A illustrates the case where three modes are present (stratified, split, and homogeneous). FIG. 7B illustrates the case where two modes are present (stratified and homogeneous).

While the invention has been described in connection with one or more embodiments, it should be understood that the invention is not limited to those embodiments. Accordingly, the invention covers all alternatives, modifications, and equivalents, as may be included within the spirit and scope of the invention.

What is claimed is:

1. A system for use in a vehicle comprising:

an engine capable of operating in at least a first operating mode characterized by stratified combustion and a second operating mode characterized by homogeneous combustion, and a controller for determining a parameter indicative of atmospheric pressure and selecting the first mode when a desired engine output is below a threshold in selecting the second mode when said desired engine output is above said threshold, wherein said threshold is adjusted based on said parameter.

2. A method for controlling an internal combustion engine of a vehicle, the engine operating in at least the first or second operating mode, the method comprising:

determining a parameter indicative of atmospheric pressure; and selecting one of the first and second operating modes based in part on said parameter wherein said selecting further comprises selecting the first mode when a desired engine output is below a threshold and selecting the second mode when said desired engine output is above said threshold, wherein said threshold is adjusted based on said parameter.

3. The method recited in claim 2, wherein said threshold is decreased as said parameter decreases.

4. The method recited in claim 3, wherein said determining step comprises estimating atmospheric pressure based on an engine operating condition.

5. The method recited in claim 3, wherein said determining step comprises measuring atmospheric pressure.

6. A method for controlling an internal combustion engine of a vehicle, the engine operating in at least a first operating mode characterized by stratified combustion and a second operating mode characterized by homogeneous combustion, the method comprising:

determining a parameter indicative of atmospheric pressure;

determining a desired engine output based at least on a driver actuated element; and selecting the first mode when said desired engine output is below a threshold and selecting the second mode when said desired engine output is above said threshold, wherein said threshold is adjusted based on said parameter.

7. The method recited in claim 6 wherein said determining further comprises estimating said parameter indicative of atmospheric pressure based on an engine operating condition.

8. The method recited in claim 7 wherein said engine operating condition comprises at least one parameter selected from the group consisting of engine speed, throttle position, engine airflow, manifold pressure, and temperature.

9. The method recited in claim 8 wherein said desired engine output is a desired engine torque.

10. The method recited in claim 6 wherein said determining further comprises measuring atmospheric pressure.

11. A method for controlling an internal combustion engine of a vehicle, the engine operating in at least a first operating mode characterized by stratified combustion and a second operating mode characterized by homogeneous combustion, the method comprising:

determining a parameter indicative of atmospheric pressure based at least on one of a mass air flow sensor and a manifold pressure sensor;

determining a desired engine output torque based at least on a driver actuated element;

calculating a torque threshold;

adjusting said torque threshold based on said parameter; and operating the engine in said first stratified mode when said desired engine output torque is less than said torque threshold, and operating the engine in said second homogeneous mode when said desired engine output torque is greater than said torque threshold.

12. A method for controlling an internal combustion engine of a vehicle, the engine operating in at least a first and second operating mode, the method comprising:

determining a parameter indicative of atmospheric pressure, wherein said parameter is based on a global positioning system; and selecting one of the first and second operating modes based in part on said parameter.

13. A method for controlling an internal combustion engine of a vehicle, comprising:

determining a barometric pressure communicating with said vehicle based on information received from a global positioning system; and adjusting fuel injection into said engine based on said barometric pressure.

14. The method recited in claim 13, wherein said adjusting further comprises changing a fuel injection timing based on said barometric pressure.

* * * * *